US008915762B2

(12) United States Patent
Mostert et al.

(10) Patent No.: US 8,915,762 B2
(45) Date of Patent: Dec. 23, 2014

(54) CATAMARAN VESSEL WITH HYBRID PROPULSION FOR EMBARKING AND DISEMBARKING LOADS

(75) Inventors: Maarten Mostert, La Crau (FR); Gregory Pelard, La Crau (FR)

(73) Assignee: Constructions Industrielles de la Mediterranee—CNIM, Paris (FR)

( * ) Notice: Subject to any disclaimer, the term of this patent is extended or adjusted under 35 U.S.C. 154(b) by 0 days.

(21) Appl. No.: 13/501,959

(22) PCT Filed: May 12, 2011

(86) PCT No.: PCT/FR2011/051063

§ 371 (c)(1),
(2), (4) Date: Apr. 3, 2013

(87) PCT Pub. No.: WO2012/131178

PCT Pub. Date: Oct. 4, 2012

(65) Prior Publication Data

US 2014/0017962 A1 Jan. 16, 2014

(30) Foreign Application Priority Data

Mar. 31, 2011 (FR) ..... 11 00968

(51) Int. Cl.

| | |
|---|---|
| ***B63H 11/00*** | (2006.01) |
| ***B63H 21/20*** | (2006.01) |
| ***B63B 1/12*** | (2006.01) |
| ***B63B 35/54*** | (2006.01) |

(52) U.S. Cl.

CPC *B63H 21/20* (2013.01); *B63B 1/12* (2013.01); *B63B 35/54* (2013.01)

USPC ..... 440/38; 114/67 A; 114/61.15

(58) Field of Classification Search

USPC ..... 114/61.15, 67 A; 440/38

See application file for complete search history.

(56) References Cited

U.S. PATENT DOCUMENTS

| | | | | |
|---|---|---|---|---|
| 3,835,802 | A * | 9/1974 | Vernede et al. | 114/260 |
| 5,111,763 | A * | 5/1992 | Moerbe | 114/246 |
| 5,921,195 | A * | 7/1999 | Yilmaz | 114/48 |
| 6,293,216 | B1 * | 9/2001 | Barsumian | 114/67 A |
| 6,508,188 | B2 * | 1/2003 | Dong et al. | 114/67 R |
| 6,520,104 | B1 * | 2/2003 | Svensson | 114/144 R |
| 6,604,478 | B2 * | 8/2003 | Barsumian | 114/67 A |
| 6,855,018 | B2 * | 2/2005 | Burg | 440/38 |
| 6,877,450 | B2 * | 4/2005 | Schmidt et al. | 114/61.15 |
| 7,634,971 | B2 * | 12/2009 | Lucas | 114/61.15 |
| 2002/0164231 | A1 * | 11/2002 | Lucas et al. | 414/137.4 |
| 2003/0033967 | A1 * | 2/2003 | Hayman, III | 114/61.15 |
| 2004/0134402 | A1 * | 7/2004 | Schmidt et al. | 114/61.15 |
| 2007/0251440 | A1 * | 11/2007 | Lucas | 114/61.15 |
| 2012/0164896 | A1 * | 6/2012 | Kobayashi et al. | 440/38 |
| 2014/0017962 | A1 * | 1/2014 | Mostert et al. | 440/38 |

FOREIGN PATENT DOCUMENTS

| | | | |
|---|---|---|---|
| FR | 2 804 933 | A1 | 8/2001 |

* cited by examiner

*Primary Examiner* — Lars A Olson
*Assistant Examiner* — Jovon Hayes
(74) *Attorney, Agent, or Firm* — Leydig, Voit & Mayer, Ltd.

(57) ABSTRACT

A catamaran vessel with hybrid propulsion engines for driving propeller propulsors and pump-jet propulsors. The vessel includes two side hulls and a mobile platform that can be moved between upper and lower positions relative to the side hulls to accommodate navigation conditions. The engines are selectively coupled to the propeller propulsors, the pump jet propulsors, and control mechanisms changing the position of the mobile platform-between the upper and lower positions.

20 Claims, 4 Drawing Sheets

Fig.4
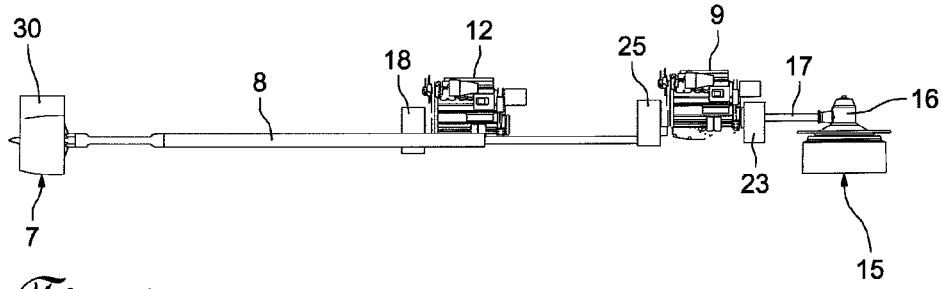
Fig.5
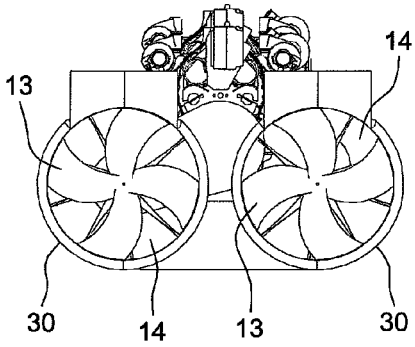
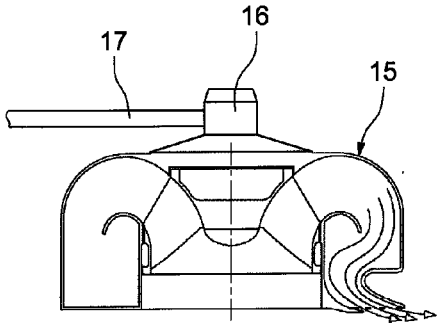
Fig.6
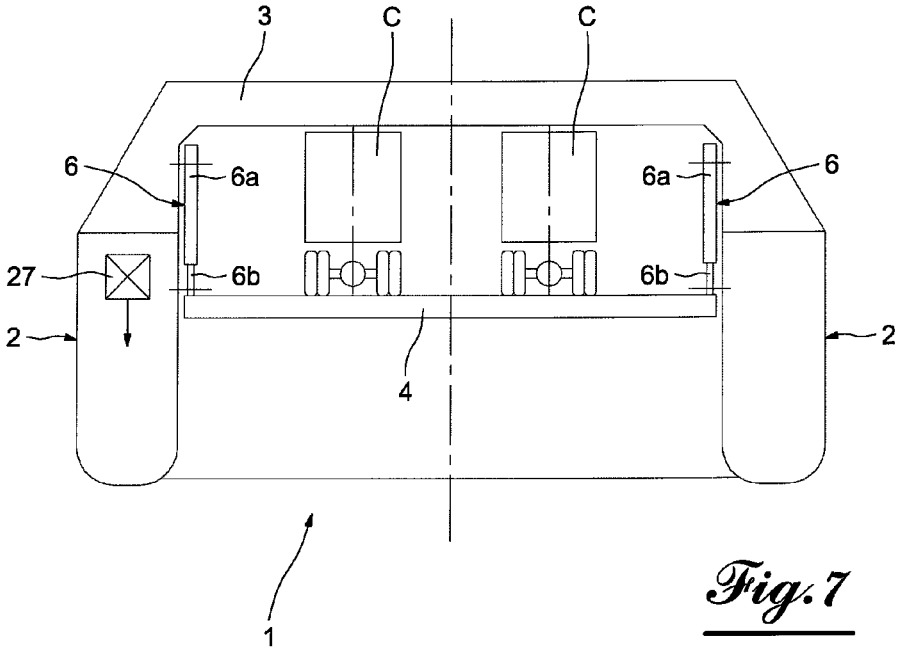
Fig.7

CATAMARAN VESSEL WITH HYBRID PROPULSION FOR EMBARKING AND DISEMBARKING LOADS

FIELD OF THE INVENTION

The present invention concerns a catamaran vessel for embarking and disembarking loads.

BACKGROUND

Such a vessel is described in particular in international patent application publication WO 2006/037663 to the Applicant and comprises two side hulls connected to one another at each of their ends and at an upper part by cross-beams, and a mobile platform located between the two side hulls.

The mobile platform is a sealed caisson having an upper part capable of withstanding loads. Mechanisms are provided to vary the position of the mobile platform in relation to the two side hulls, between an upper position, in which the vessel floats solely via the two side hulls, and a lower position, in which the vessel floats via the platform and the two side hulls.

With the platform in lower position, the vessel converts to a landing craft (landing craft mode) and the vessel's draft is reduced by the additional buoyancy of the platform. This landing craft mode allows approaches to beaches, in particular, or to river banks in very shallow waters and, for example, allows the disembarking of equipment and military or non-military personnel on non-developed shorelines.

When the platform is in upper position, the vessel converts to a catamaran (catamaran mode) allowing the vessel to travel at high speed on its profiled hulls even in rough seas.

The mechanisms varying the position of the mobile platform between the upper and lower positions comprise hoisting means, possibly including one or more pairs of hydraulic cylinders located on each side of and along the platform. The hydraulic cylinders are hinged between the side hulls and the mobile platform of the vessel. The hydraulic cylinders can be actuated by control means, such as hydraulic pumps, which may be driven by geared motor assemblies.

In addition, the vessel is provided with a maneuvering and propulsion device, arranged symmetrically in the two side hulls, substantially at the bottom of the hulls, comprising two motorized propulsion systems, including hydrojets with steering and reversing mechanisms, ensuring good maneuverability of the vessel.

Hydrojets ensure a good propulsion yield, about 0.55 to 0.65 for vessel travel speeds ranging between about 30 and about 45 knots, with a water intake located underneath the corresponding side hull of the vessel. Each hydrojet is capable of operating in very shallow drafts.

However, hydrojets provide a less good propulsion yield, of between about 0.35 and 0.5, at slower navigating speeds of the vessel, speeds ranging from about 12 to about 25 knots. Each hydrojet suffers from the cavitation phenomenon at low speeds unless its dimensions are significantly increased to avoid this phenomenon. The increase in dimensions is detrimental to the overall weight of the vessel.

SUMMARY OF THE INVENTION

It is the objective of the present invention to provide a vessel for embarking and disembarking loads, allowing the mobile platform to be moved between its upper and lower positions between the two side hulls whilst ensuring a good propulsion yield and excellent vessel maneuverability irrespective of its navigation speed and irrespective of the mode of this vessel, whether landing craft or catamaran mode.

For this purpose, according to the invention, the vessel for embarking and disembarking loads, of catamaran type comprises two side hulls, a mobile platform between the two side hulls, and is characterized in that it comprises motorized propulsion devices arranged symmetrically at least partly in the two side hulls including, firstly, aft of each side hull, at least one motorized propulsor with propeller and rudder located underneath the side hull to move and maneuver the vessel at relatively high speeds, and, secondly, forward of each side hull, a motorized propulsor of pump jet type located in the side hull in the vicinity of the bottom thereof and aspirating water vertically in very shallow drafts and expelling the water via nozzles swivelling through 360° relative to the vessel, allowing maneuverability of the vessel even at very low speeds, mechanisms varying the position of the mobile platform, relative to the side hulls, between an upper position in which the vessel floats solely via the two side hulls for the use of propulsors of propeller type, and a lower position in which the vessel floats via the mobile platform and the two side hulls in very shallow drafts, for use of propulsors of pump jet type, and in that at least one of the engines of the propeller or pump jet type propulsors is selectively coupled either with the propeller or with the pump jet propulsor, or with means for controlling the mechanisms varying the position of the mobile platform relative to the two side hulls, between the upper and lower positions, to bring the platform to an upper position or a lower position depending on the vessel's navigation conditions.

Preferably, the two engines of the propeller propulsors respectively arranged in the two side hulls are selectively coupled either with the two propeller propulsors or with two control means which control mechanisms varying the position of the mobile platform, relative to the two side hulls, between the upper and lower positions.

Advantageously, each engine of the pump jet propulsor arranged in each side hull is selectively coupled either with the propeller propulsor or with another propeller propulsor or with the pump-jet propulsor.

Each engine of a pump jet propulsor can be coupled, firstly, via a controlled clutch and reduction gear assembly with a drive shaft of the corresponding propeller propulsor or of the other corresponding propeller propulsor and, secondly, via another controlled clutch and reduction gear assembly, with a drive shaft of the corresponding pump-jet propulsor, and the two clutches are controlled so that one is disengaged and the other is engaged, i.e., reciprocally.

Each engine of a propeller propulsor is coupled with the input of a reduction gear having two outputs, of which one output is coupled with the drive shaft of the propeller propulsor via a controlled clutch, and the other output is coupled with the control means via a controlled clutch, the two clutches being controlled so that one is disengaged and the other is engaged, i.e., reciprocally.

When the platform is in its upper position, each engine is coupled with the propeller propulsor via the corresponding controlled clutch in an engaged position, and each other engine is coupled either with the other propeller propulsor via the corresponding controlled clutch in an engaged position, or with the pump-jet propulsor via the corresponding controlled clutch in an engaged position.

As a variant, when the platform occupies the upper position, each engine is coupled with the propeller propulsor via the corresponding controlled clutch, and each other engine is stopped with the corresponding controlled clutch in the disengaged position to allow the propellers of the other propeller propulsor to rotate freely.

According to another variant, when the platform is in its upper position, each engine is stopped with the corresponding controlled clutch in the disengaged position to allow the propellers of the propeller propulsor to rotate freely, and each other engine is coupled with the pump jet propulsor with the corresponding controlled clutch in the engaged position.

According to another embodiment, each engine of a propeller propulsor can be coupled, firstly, via a controlled clutch with the input of the reduction gear of which one output is coupled with the propeller propulsor via the drive shaft, and, secondly, with the control means via a controlled clutch, and the reduction gear has another input connected to the engine of the pump jet propulsor via the controlled clutch, the two clutches being controlled so that one is in the disengaged position and the other is in the engaged position, i.e., reciprocally.

As a variant, when the platform takes the upper position, each engine is coupled with the propeller propulsor via the reduction gear and the controlled clutch in the engaged position, and each engine can be coupled with the propeller propulsor via the clutch in the engaged position and the reduction gear, each engine being uncoupled from the pump jet propulsor by the clutch in the disengaged position.

According to another variant, when the platform is the upper position, each engine is coupled with the propeller propulsor via the reduction gear and the controlled clutch in the engaged position, and each engine is coupled with the pump jet propulsor via the clutch in the engaged position, each engine being uncoupled from the propeller propulsor by the corresponding clutch in the disengaged position.

According to yet another variant, when the platform occupies the upper position, each engine is stopped and the clutch coupling the engine with the propeller propulsor is operated towards the disengaged position, and each engine is coupled with the pump jet propulsor by the clutch in the engaged position and is uncoupled from the propeller propulsor by the clutch operated towards the disengaged position, thereby allowing the propellers of this propulsor to rotate freely.

According to a still further variant, when the platform is in the lower position, each engine is coupled with the pump jet propulsor via the corresponding controlled clutch in the engaged position, and each other engine can be coupled with the propeller propulsor via the corresponding controlled clutch in the engaged position.

The mechanisms varying the position of the mobile platform between the lower and upper positions comprise hoisting means including hydraulic cylinders hinge-mounted between the platform and the two side hull. Each control means includes a hydraulic pump connected via a hydraulic circuit to the hydraulic cylinders.

Advantageously, the mechanisms comprise at least two pairs of hydraulic cylinders located along the platform of the vessel. The hydraulic cylinders are controlled by hydraulic pumps.

Advantageously, the controlled clutches are hydraulic.

The clutches are controlled from a pilot bridge on-board the vessel.

The engines of the propeller propulsors and of the pump jet propulsors are Diesel engines.

BRIEF DESCRIPTION OF DRAWING FIGURES

The invention will be better understood and other objectives, characteristics, details, and advantages will become more clearly apparent from the explanatory description given below with reference to the appended drawings, given solely as examples illustrating an embodiment of the invention and in which:

FIG. 4 is a side view along arrow IV of FIG. 3 showing the propulsion devices associated with a side hull of the vessel;

FIG. 5 is a rear view of a side hull along arrow V of FIG. 3;

FIG. 6 is an overall view of the propulsor of pump jet type used in each side hull of the vessel;

FIG. 7 is a schematic front view of the vessel;

DETAILED DESCRIPTION

Figure 1:
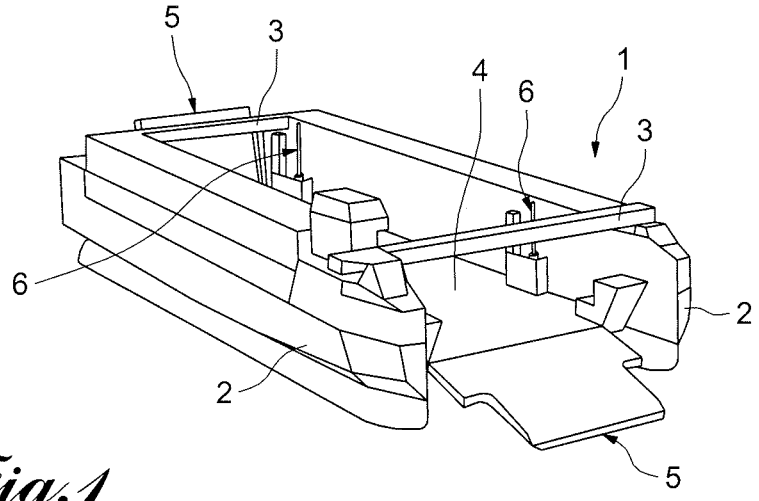
FIG. 1 is a perspective view of a vessel of catamaran type in embarking or disembarking position.
Figure 2:
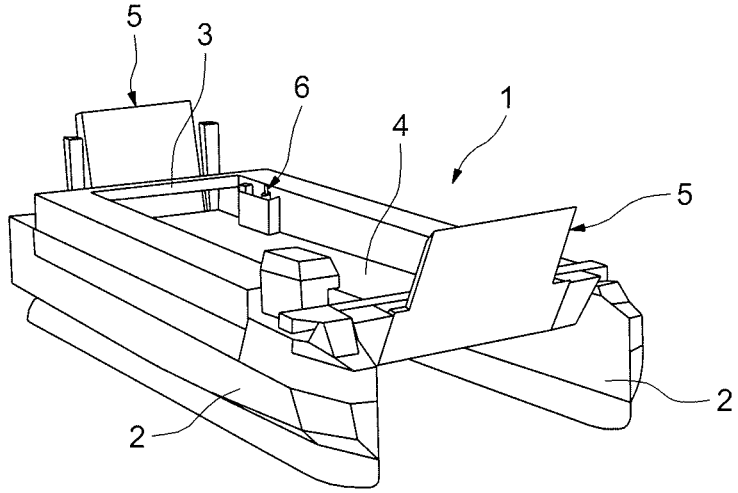
FIG. 2 is a perspective view of the vessel in FIG. 1 in a transit position.

With reference to FIGS. 1 to 9, reference 1 designates a vessel in the form of a catamaran comprising two side hulls 2 which are connected, at each of their ends and at an upper part, via two beams 3 ensuring rigidity of the vessel.

The vessel also comprises a mobile platform 4 arranged between the two side hulls 2 and which includes a sealed caisson with an upper part that is a roll-on roll-off surface able to withstand loads. The loads may consist of vehicles, such as trucks C as illustrated in FIG. 7.

The mobile platform 4, at at least one of its ends, comprises a deployable ramp 5 pivot mounted on the mobile platform 4 transverse to its longitudinal direction. The mobile platform is able to take a lowered position, as illustrated for the front deployable ramp 5 in FIG. 1, to form a loading or unloading corridor of uniform width. That width is substantially equal to the spacing between the two side hulls. The ramp 5 can take a raised position, as in FIG. 2, to provide protection against waves and spray for the loads transported by the vessel and located on the mobile platform 4.

The vessel also comprises mechanisms varying the position of the mobile platform 4, relative to the two side hulls 2 between an upper position in which the vessel floats solely via the two side hulls 2, thereby configuring the vessel in catamaran mode, and a lower position in which the vessel 1 floats via the platform 4 and the two side hulls 2, configuring the vessel in landing craft mode for navigation in very shallow drafts.

Preferably, these mechanisms comprise at least two pairs of hydraulic cylinders 6 arranged along the mobile platform 4 of the vessel 1, each hydraulic cylinder 6 extending perpendicular to the mobile platform 4 and being hinge-mounted between the corresponding side hull 2 and the mobile platform 4. For example, the cylinder **6*a* of each hydraulic cylinder 6 is secured in hinged fashion via its upper end to the inner surface of the corresponding side hull 2, whilst the rod 6*b* of the cylinder, at its lower end, is secured in hinged fashion to the corresponding side of the mobile platform 4**.

The vessel 1 is also equipped with motorized propulsion devices respectively associated with the two side hulls 2 and arranged symmetrically relative to the median longitudinal plane of the vessel 1, a plane extending perpendicular to the mobile platform 4.

The motorized propulsion devices, aft of each side hull 2, comprise a first propeller propulsor 7, with a rudder located underneath the side hull 2, to move and maneuver the vessel at relatively high speeds.

The propeller propulsor 7 is installed on the underside of the hull of the vessel's transom and is coupled with a drive shaft 8, driven by an engine 9 housed in the side hull 2.

The propulsion devices also comprise, associated with each hull 2, a second propeller propulsor 10, with a rudder, installed under the hull of the transom, at the aft end of the vessel, and which is coupled with a drive shaft 11. The drive shaft 11 is coupled with an engine 12 housed in the corresponding side hull 2 of the vessel 1.

Each propeller propulsor 7, 10 may be of pump-propeller type including a nozzle 30 surrounding a propeller 13 and flow guiding fins 14, as is known. The advantage of a pump-propeller is that it has a good yield, of the order of 0.6 to 0.7, over a range of navigation speeds of the vessel of between 10 and 30 knots.

Evidently, each propeller propulsor 7, 10 may be of a type different from a pump-propeller, e.g., conventional propeller, surface propeller, or pod-type propeller.

The vessel's propulsion devices further comprise, forward of each side hull 2 and inside the hull, in the vicinity of the bottom of the hull, a motorized propulsor of pump jet type 15, which is known and capable of aspirating water vertically from very shallow drafts and of expelling the water via nozzles swivelling through 360° relative to the vessel. The propulsor of the pump jet type enables the vessel to be maneuverable at low speeds, in particular, less than 10 knots, as illustrated in FIG. 6.

Each pump jet propulsor 15 is coupled via a bevel gear 16 with a drive shaft 17 which may be coupled with the engine 9 driving the corresponding propeller propulsor 7, as will be seen below.

The pump jet propulsors 15 enable the vessel 1 to navigate in shallow waters which may be less than 0.5 meters deep, and are, therefore, particularly adapted for navigation of the vessel in landing craft mode.

The pump jet propulsors may be of the type manufactured by the companies SCHOTTEL and ZF.

The engines 9, 12 driving the propeller propulsors 7, 10 and pump jet propulsor 15 may be Diesel engines.

Each engine 12 has a drive shaft coupled with an input shaft of a reduction gear 18 via a controlled clutch 19.

The reduction gear 18 comprises two output shafts, of which one may be coupled to the drive shaft 11 via a controlled clutch 20 and the other output shaft is coupled to the drive shaft of control means 21 via a controlled clutch 22, the control means 21 actuating the mechanisms 6 moving the mobile platform 4 relative to the two side hulls 2 between the upper and lower positions.

If the mechanisms 6 include hydraulic cylinders, the control means 21 includes a hydraulic pump.

Each engine 9 has one of its output shafts coupled with the input shaft of a reduction gear 23 via a controlled clutch 24, the output shaft of the reduction gear 23 being coupled to the drive shaft 17 of the corresponding pump jet propulsor 15. In addition, the engine 9 has a second output shaft coupled to an input shaft of another reduction gear 25 via another controlled clutch 26, with the output shaft of the reduction gear 25 being coupled to the shaft 8 driving the corresponding propeller propulsor 7.

Preferably, the different clutches 19, 20, 22, 24 and 26 are hydraulic and controlled from a pilot bridge 27 on-board the vessel as symbolized in FIG. 7.

Figure 3:
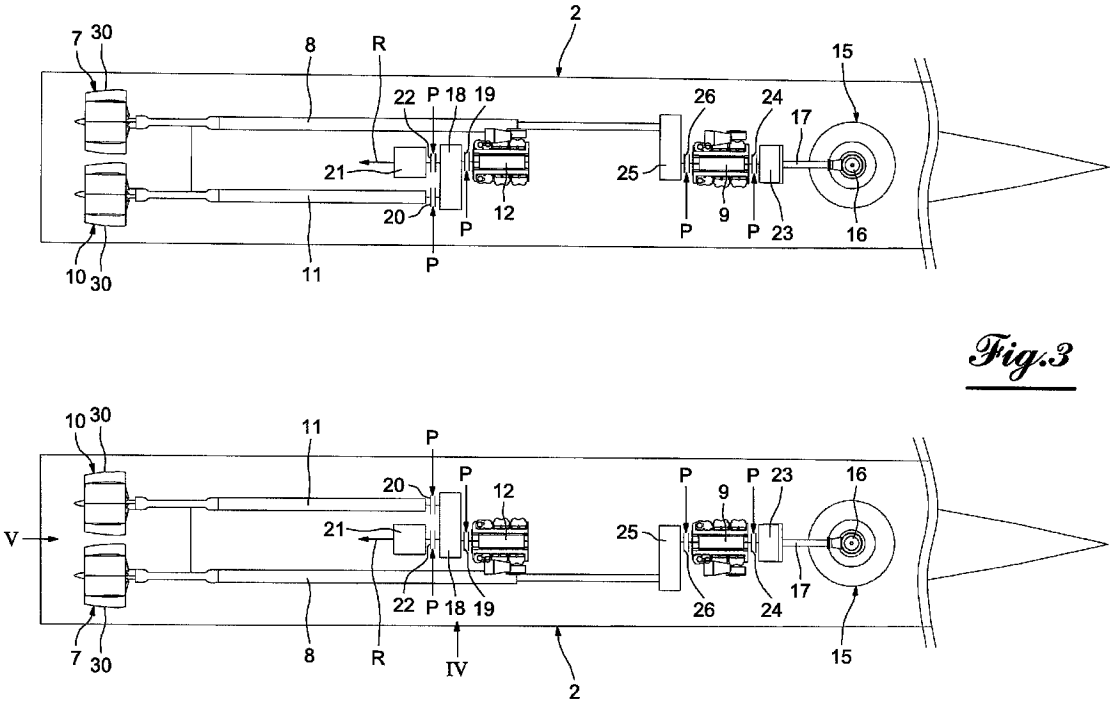
FIG. 3 is an overhead view of two side hulls of the vessel in FIGS. 1 and 2 showing the motorized propulsion devices associated with the side hulls according to a first embodiment.

FIG. 3 shows that the clutches 19, 20, 22, 24 and 26 are driven by a signal P from the pilot bridge 27 and that the two hydraulic pumps 21 of the control means of the hydraulic cylinders 6 are connected, as symbolized by the arrow R, to the cylinders via a suitable hydraulic circuit. One of the hydraulic pumps is able to actuate the hydraulic cylinders 6 located on the port side of the vessel 1 and the other hydraulic pump 21 is able to actuate the hydraulic cylinders located on the starboard side of the vessel.

The hydraulic circuit is easily designed by persons skilled in the art and does not need to be detailed.

The two engines 12 respectively driving the two propeller propulsors 10 can be used to provide the power needed to move the mobile platform 4 from the upper position to its lower position and from the lower position to the upper position.

For this purpose, the two clutches 19 are controlled from the pilot bridge 27 towards disengaged positions to temporarily uncouple the reduction gears 18 from the engines 12. Then, the pilot bridge 27 controls the two clutches 20 towards disengaged positions to uncouple the two drive shafts 11 of the propeller propulsors 12 from the corresponding output shafts of the reduction gears 18. The pilot bridge simultaneously controls the two clutches 22 towards the engaged positions to couple the other output shafts of the reduction gears 18 to the two hydraulic pumps 21. The pilot bridge 27 then again controls the two clutches 19 to bring them to the engaged positions, coupling the input shafts of the reduction gears 18 to the engines 12 for driving of the two hydraulic pumps 21. The pump, provide hydraulic fluid to the hydraulic cylinders 6 and actuate the hydraulic cylinders in a direction lifting or lowering the mobile platform 4 between the two side hulls 2 of the vessel 1.

During the movement of the mobile platform 4 between the two side hulls 2 of the vessel 1, the two other engines 9 can be used by being selectively coupled either with the propeller propulsors 7, or with the pump jet propulsors 15, depending on the desired navigation conditions.

More specifically, to couple each engine 9 to the associated propeller propulsor 7, the pilot bridge 27 operates the clutch 24 to bring it to the disengaged position, in which the reduction gear 23 is uncoupled from the engine 9, and operates the other clutch 26 towards the engaged position, in which the reduction gear 25 is coupled with the engine 9, ensuring driving of the propeller propulsor 7 via the drive shaft 8.

To ensure propulsion of the vessel by the pump jet propulsors 15, the pilot bridge 27 operates the clutches 24 towards the engaged positions, in which each engine 9 is coupled with the drive shaft 17 of the corresponding pump jet propulsor 15 via the reduction gear 23, and operates the other clutch 26 towards the disengaged position, in which the drive shaft 8 of the corresponding propeller propulsor 7 is uncoupled from the engine 9.

The choice of coupling the engines 9 with the propeller propulsors 7 or pump jet propulsors 15 depends on the configuration towards landing craft mode or catamaran mode of the vessel 1, when controlling the movement of the mobile platform 4 between the upper and lower positions.

When the vessel converts to landing craft mode, its navigation via the propeller propulsors 7 is compromised since the propellers may partly emerge from the water, causing the phenomenon of cavitation, leading to a drop in yield and a strong reduction in the vessel's propulsion power. By uncoupling the drive shafts 8 of the propeller propulsors 7 from the engines 9 via clutches 26, in the disengaged position, and by coupling the drive shaft 17 of the pump jet propulsors 15 with the engines 9 via the clutches 24 in the engaged position, the vessel 1 is driven by the pump jet propulsors 15 which operate in extremely shallow waters, compatible with the draft of the vessel when navigating in landing craft mode.

When the vessel 1 converts to catamaran mode, the propellers 13 of the propulsors 7 will become immersed as and when the draft increases, and the more the propellers are immersed the more remote the problem of cavitation and the greater the propulsion power of the propellers. It is then possible to use the propeller propulsors 7, taking advantage of their good yield in accordance with the different navigational conditions of the vessel in catamaran mode. Therefore, towards the end of the movement of the mobile platform 4 towards the upper position and when the propellers 13 of the propulsors 7 are sufficiently immersed to start transmitting vessel propulsion power, the pilot bridge 27 controls the clutches 24 towards the disengaged positions to uncouple the drive shafts 17 of the pump-jet propulsors 15 from the engine 9. The clutches 26 are operated towards the engaged positions to couple the engines 9 to the drive shafts 8 of the propeller propulsors 7.

Once the mobile platform 4 is in the upper position or lower position, the vessel is able to navigate in catamaran mode or landing craft mode, respectively.

The navigation of the vessel in catamaran mode is especially used for sea navigation from one place to another, travelling at the fastest possible speed and/or the most economically possible with or without load, away from the constraints of very shallow drafts. The greater part of the vessel's journeys travelling from one point to another by sea in catamaran mode is performed with the best possible improved propulsion yield and maximum power through use of the propeller propulsors. In catamaran navigational mode, the vessel has no speed limit, other than that imposed by the place of navigation, whether a port area or coastal area.

Therefore, when the vessel 1 navigates in catamaran mode, there is a choice of several types of propulsion.

According to a first type of propulsion, the four propeller propulsors 7, are used by coupling, firstly, the engines 12 to the drive shafts 11 of the propeller propulsors 10 via clutches 19, 20 operated in the engaged position, the clutches 22 operated towards the disengaged position, and, secondly, by coupling the engines 9 to the drive shafts 8 of the propeller propulsors 7 via clutches 26 operated in the engaged position, with the clutches 24 operated in the disengaged position, uncoupling the drive shafts 17 of the pump jet propulsors 15 from the engines 9. This type of propulsion allows the movement of the vessel 1 at relatively high speeds and at maximum power, if needed.

According to a second type of propulsion of the vessel 1, the two propeller propulsors 10 are driven by the engines 12 via the drive shafts 11, clutches 19, 20 in the engaged position, and the reduction gears 18 and, at the same time, the two other engines 9 are coupled, via clutches 24 in the engaged position, the reduction gears 23, and the drive shafts 17, to the pump jet propulsors 15. This navigation mode can be used when the vessel 1 requires strong propulsion power provided by the propeller propulsors 10 and high maneuvering capability provided by the pump jet propulsors 15.

According to a third type of propulsion for the vessel 1, the propeller propulsors 10 are driven by the engines 12 in the same manner as in the second type of propulsion, and the two other engines 9 are stopped, with the clutches 26 operated in the disengaged position, to allow the propellers 13 of the propulsors 7 to rotate freely to minimize drag on the vessel 1. This navigation mode can be used when the speeds required for propelling the vessel are relatively slow, for example, about twelve knots.

According to a fourth type of propulsion, the two engines 9 are coupled with the pump jet propulsors 15 via clutches 24 in the engaged position, the reduction gears 23, and the drive shafts 17, with the clutches 26 in the disengaged position, and the two engines 12 are stopped with the clutches 19 in the disengaged position and/or the drive shafts 11 of propeller propulsors 10 uncoupled from the reduction gears 18 by the clutches 20 operated in the disengaged position, allowing the propellers 13 of the propulsors 10 to rotate freely to minimize drag on the vessel 1. This navigation mode can be used when the vessel 1 needs maneuvering capability or must dynamically maintain its position.

For navigation in landing craft mode, the vessel 1 has significant maneuvering needs associated with navigation of the vessel in very shallow drafts, at reduced travel speeds, since the platform 4 is partly immersed in the water. Through its immersion, the platform 4 not only slows down the vessel 1, but the safety of persons on the platform 4 is better ensured if the vessel moves at reduced speed. The navigation of the vessel in landing craft mode is chiefly used during approach phases to ports, beaches, and shorelines to embark or disembark loads or during the approach phase of a large capacity vessel on which the vessel 1 of the invention is to be embarked or with which the vessel 1 is to conduct vessel-to-vessel operations for embarking or disembarking at sea. When the vessel travels at reduced speed, constraints regarding the propulsion yield of the motorized propulsors are reduced since the speed is generally limited to about 10 knots. On the other hand, the need for large maneuvering capacity is often quite high, precisely because of the approach to ports, shorelines, or a vessel to embark the vessel 1, or any other large capacity vessel.

During navigation of the vessel 1 in landing craft mode, the two engines 9 are coupled with the pump jet propulsors 15 via the clutches 24 in the engaged position, the reduction gears 23, and the drive shafts 17. The clutches 26 are operated in the disengaged position. In this navigation mode, it is possible to couple the engines 12 to the propeller propulsors 10 via the clutches 19, 20, in the engaged position, the reduction gears 18, and the drive shafts 11, when the load embarked on-board the vessel 1 is such that the propellers 13 of the propulsors 10 are at least partly under the water, allowing their use with a certain cavitation risk for a limited time. This navigation mode using pump-jet propulsors 15 and propeller propulsors may be of advantage to move the vessel away from a beach using maximum thrust power.

Various variants of the invention can be implemented without departing from the scope of the present invention.

For example, the engines for movement of the mobile platform 4 between the upper and lower positions, between the two side hulls 2 of the vessel 1, may be the engines 9 driving the pump jet propulsors 15 instead of the engines 12. In this case, each engine 9 will be selectively coupled either with the drive shaft 8 of the propeller propulsor 7 via the clutch 26 in the engaged position, or with a reduction gear, clutch, and hydraulic pump assembly identical to the reduction gear 18, clutch 20, 22, and hydraulic pump 21 assembly associated with the engine 12.

Figure 8:
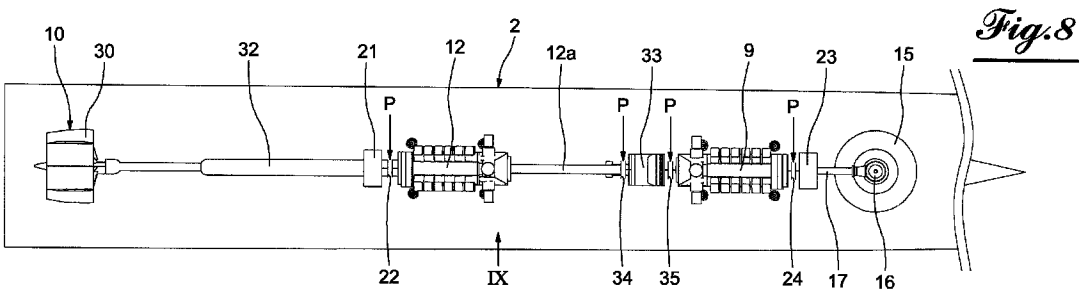
FIG. 8 is an overhead view of one of the side hulls of the vessel in FIGS. 1 and 2 showing the motorized propulsion devices associated with the hull according to a second embodiment of the invention.
Figure 9:
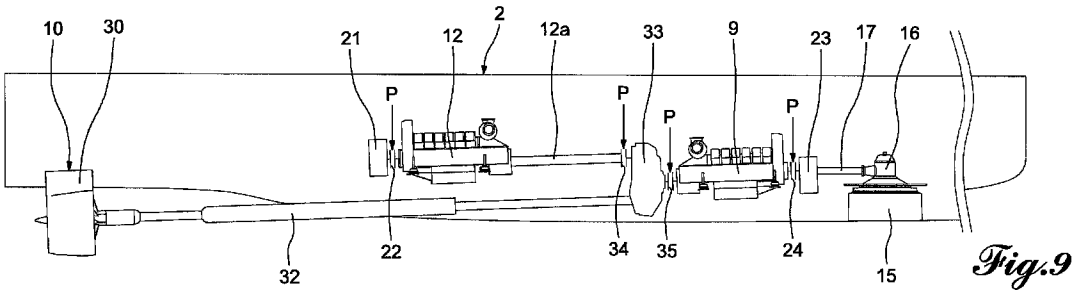
FIG. 9 is a side view along arrow IX of FIG. 8.

FIGS. 8 and 9 illustrate a second embodiment of the vessel 1 also equipped with motorized propulsion devices respectively associated with the two side hulls 2 and arranged symmetrically relative to the median longitudinal plane of the vessel 1, a plane extending perpendicular to the mobile platform 4.

In these figures, only one of the side hulls 2 of the vessel 1 is illustrated, the other side hulls 2 comprising the same motorized propulsion devices. According to this embodiment, these motorized propulsion devices, aft of each side hull 2, comprise a single propeller propulsor 10 with rudder located underneath the side hull 2 to move and maneuver the vessel at relatively high speeds.

The propeller propulsor 10 is installed under the hull of the vessel's transom and is coupled to a drive shaft 32, which is coupled to a reduction gear 33, driven by one of the engines 9 and 12 or both, housed in the side shell 2.

Each propeller propulsor 10 may be of pump-propeller type including a nozzle 30 surrounding a propeller 13 and flow directing fins 14, as is known.

The vessel propulsion devices further comprise, forward of each side hull 2 and in the vicinity of the bottom of the hull, a motorized propulsor of pump-jet 15 type, aspirating water vertically from very shallow drafts and expelling the water via nozzles swivelling through 360° C. relative to the vessel, enabling the vessel to be maneuvered at low speeds, in particular, less than 10 knots, as illustrated in FIG. 6.

Each pump jet propulsor 15 is coupled via a bevel gear 16 with a drive shaft 17, coupled to the engine 9 driving the propeller propulsor 10, as will be seen below.

Pump jet propulsors 15 enable the vessel 1 to navigate in shallow waters, possibly less than 0.5 meters in depth, and are, therefore, particularly suited for navigation of the vessel in landing craft mode.

The pump jet propulsors may be of the type manufactured by the companies SCHOTTEL and ZF.

The engines 9, 12 driving the propeller 10 and pump jet 15 propulsors 10 may be Diesel engines.

Each engine 12 has one of its output shafts coupled to a drive shaft of control means 21 via a controlled clutch 22, the control means 21 actuating the mechanisms 6 moving the mobile platform 4 relative to the two side hulls 2 between the upper and lower positions. If the mechanisms 6 include hydraulic cylinders, the control means 2 includes a hydraulic pump.

In addition, in this embodiment, the engine 12 has a second output shaft 12*a* coupled to an input shaft of the reduction gear 33 via another controlled clutch 34, the output shaft of the reduction gear 33 being coupled to the drive shaft 32 of the corresponding propeller propulsor 10.

Each engine 9 has one of its output shafts coupled to the input shaft of a reduction gear 23 via a controlled clutch 24, the output shaft of the reduction gear 23 being coupled with the drive shaft 17 of the corresponding pump jet propulsor 15. Also, in this embodiment, the engine 9 has a second output shaft coupled to an input shaft of the reduction gear 33 via another controlled clutch 35, the output shaft of the reduction gear 33 being coupled to the drive shaft 32 of the corresponding propeller propulsor 10.

Each engine 9 and 12 therefore has one of its output shafts coupled with an input shaft of the reduction gear 33 via a controlled clutch 34, 35. The reduction gear 33 which, through the drive shaft 32, drives the propeller propulsor 10, can either be driven by the engine 12 via the controlled clutch 34 and/or by the engine 9 via the controlled clutch 35.

Preferably, the different clutches 22, 24, 34 and 35 are hydraulic and controlled from the pilot bridge 27 on-board the vessel as symbolized in FIG. 7.

FIG. 9 shows that the clutches 22, 24, 34 and 35 are driven by a signal P derived from the pilot bridge 27 and that the two hydraulic pumps 21 of the control means of the hydraulic cylinders 6 are connected, as symbolized by the arrow R, to the cylinders via a hydraulic circuit so that one of the hydraulic pumps actuates the hydraulic cylinders 6 located on the port side of the vessel 1 and the other hydraulic pump 21 actuates the hydraulic cylinders located on the starboard side of the vessel.

The hydraulic circuit can easily be designed by persons skilled in the art and does not need to be described further.

The two engines 12 respectively driving the two propeller propulsors 10 can be used to provide the necessary power to move the mobile platform 4 from the upper position to the lower position, or from the lower position to the upper position.

For this purpose, the two clutches 34 are operated by the pilot bridge 27 towards the disengaged position to uncouple, temporarily, the reduction gears 33 from the engines 12. The pilot bridge then operates the two clutches 22 to the engaged position to couple the engines 12 to the two hydraulic pumps 21. The pumps supply the hydraulic fluid to the hydraulic cylinders 6, to actuate the cylinders in a direction lifting or lowering the mobile platform 4 between the two side hulls 2 of the vessel 1.

During the movement of the mobile platform 4 between the two side hulls 2 of the vessel 1, the two other engines 9 can be used by being selectively coupled to the propeller propulsors 10 or the pump jet propulsors 15, depending on the navigation conditions.

More specifically, to couple each engine 9 to the associated propeller propulsor 10, the pilot bridge 27 operates the clutch 24 to the disengaged position, in which the reduction gear 23 is uncoupled from the engine 9, and operates the other clutch 35 to the engaged position, in which the reduction gear 33 is coupled to the engine 9, ensuring the propulsion of the propeller propulsor 10 via the drive shaft 32.

To ensure propulsion of the vessel by the pump jet propulsors 15, the pilot bridge 27 operates the clutches 24 to the engaged position, in which each engine 9 is coupled to the drive shaft 17 of the corresponding pump jet propulsor 15, via the reduction gear 23, and operates the other clutch 35 to the disengaged position in which the drive shaft 32 of the corresponding propeller propulsor 10 is uncoupled from the engine 9.

The choice of coupling the engines 9 with the propeller propulsors 7 or pump-jet propulsors 15 depends on the configuration of the vessel 1 in the landing craft mode or catamaran mode when controlling the movement of the mobile platform 4 between the upper and lower positions.

When the vessel 1 navigates in catamaran mode, a choice of several types of propulsion can be used according to this second embodiment.

According to a first type of propulsion, the two propeller propulsors 10 are used by coupling the two engines 12 to the drive shafts 32 of the propeller propulsors 10 via the clutches 34, in the engaged position, and the reduction gears 33, the engines 9 being uncoupled from the pump jet propulsors 15 by operating the clutches 24 to the disengaged position. In addition, the engines 9 can also be coupled to the transmission shafts 32 of the propeller propulsors 10 via the clutches 35, operated to the engaged position, and the reduction gears 33. This type of propulsion allows the vessel 1 to navigate at relatively high speed and at maximum power, when needed.

According to a second type of propulsion of the vessel 1, the two propeller propulsors 10 are driven by the two engines 12, via the drive shafts 32, the clutches 34 in the engaged position, and the reduction gears 33, and, at the same time, the two other engines 9 are coupled via the clutches 24 in the engaged position, the reduction gears 23, and the drive shafts 17, to the pump jet propulsors 15. The clutches 35 coupling the engines 9 to the reduction gears 33 are then in the disengaged position. This navigation mode can be used when the vessel 1 requires strong propulsion power provided by the propeller propulsors 10, as well as the significant maneuvering capability provided by the pump jet propulsors 15.

According to a third type of propulsion, the two engines 9 are coupled to the pump jet propulsors 15 via the clutches 24 in the engaged position, the reduction gears 23, and drive shafts 17, and the clutches 35 coupling the engines 9 to the reduction gears 33 are operated in the disengaged position. In addition, the engines 12 are stopped and the clutches 34 coupling the engines 12 to the drive shafts 32 of the propeller propulsors 10 are operated in the disengaged position, enabling the propellers 13 of the propulsors 10 to rotate freely to minimize drag on the vessel 1. This navigation mode can be used when the vessel requires extensive maneuvering capability or must dynamically maintain its position.

During navigation of the vessel 1 in landing craft mode, the two engines 9 are coupled to the pump jet propulsors 15 via the clutches 24 in the engaged position, reduction gears 23, and drive shafts 17, the clutches 35 coupling the engines 9 to the reduction gears 33 being operated in the disengaged position. In this navigation mode, it is possible to couple the engines 12 to the propeller propulsors 10 via the clutches 34, in the engaged position, the reduction gears 33, and the drive shafts 32, when the load embarked on the vessel is such that the propellers 13 of the propulsors 10 are at least partly under the water, allowing use of the propellers with a limited risk of cavitation over time. This navigation mode using pump jet propulsors 15 and propeller propulsors 10 may be of advantage to move the vessel away from a beach by using maximum thrust power.

The above-described vessel of the invention provides movement of the mobile platform between upper and lower positions relative to the two side hulls while providing the vessel with the possibility of being propelled at high speed in catamaran mode by the propeller propulsors, or at low speed in landing craft mode by the pump jet propulsors, and offers numerous propulsion possibilities for the vessel, both in landing craft navigation mode and in catamaran navigation mode.

The invention claimed is:

1. A catamaran vessel for embarking and disembarking loads, the vessel comprising:

two side hulls, a mobile platform, mobile between the two side hulls;

motorized propulsion devices arranged symmetrically with respect to the mobile platform, in the two side hulls, each of the motorized propulsion devices including:

in the aft portion of the respective side hull, first and second propeller propulsors, each propeller propulsor having a rudder located underneath the side hull, to move and maneuver the vessel at relatively high speeds, in a forward portion of the respective side hull, a pump-jet propulsor, the pump-jet propulsor having a nozzle located in the side hull proximate a bottom of the side hull, aspirating water vertically, and expelling the water via the nozzle, the nozzle swiveling through 360° relative to the vessel, enabling maneuvering of the vessel at low speeds, a mechanism for varying the position of the mobile platform relative to the two side hulls, between an upper position, in which the vessel floats solely via the two side hulls on relatively deep water for use of the first and second propeller propulsors, and a lower position in which the vessel floats via the mobile platform and the two side hulls on relatively shallow water for use of the pump-jet propulsor, and first and second engines for driving the first and second propeller propulsors, the jet-pump propulsor, and the mechanism;

control means for controlling the mechanism of each motorized propulsion device for varying the position of the mobile platform, relative to the two side hulls, between the upper and lower positions, depending on navigation conditions, wherein the first and second engines are respectively selectively coupleable to the first propeller propulso and the pump-jet propulsor, and the second propeller propulsor and the control means.

2. The vessel according to claim 1, wherein the first engine may be coupled to the first propeller propulsor and to the pump jet propulsor and including a first controlled clutch, a first reduction gear assembly, and a first drive shaft coupling the first engine to the first propeller propulsor, and a second controlled clutch, a second reduction gear assembly, and a second drive shaft coupling the first engine to the pump jet propulsor, and the first and second controlled clutches are reciprocally controlled so that when one of the first and second controlled clutches is disengaged, the other of the first and second controlled clutches is engaged.

3. The vessel according to claim 2, wherein the second engine may be coupled to the second propeller propulsor and to the control means and including a third reduction gear, a third controlled clutch, and a third drive shaft coupling the second engine to the second propeller propulsor, and a fourth controlled clutch coupling the second engine to the control means, the third reduction gear has an input coupled to the second engine, and first and second outputs, the first output being coupled to the third drive shaft via the third controlled clutch, and the second output being coupled to the control means via the fourth controlled clutch, and the third and fourth controlled clutches are reciprocally controlled so that when one of the third and fourth controlled clutches is disengaged, the other of the third and fourth controlled clutches is engaged.

4. The vessel according to claim 3 wherein, when the platform is in the upper position, the second engine is coupled to the second propeller propulsor via the third controlled clutch, and the first engine is coupled either to the first propeller propulsor via the first controlled clutch or the pump-jet propulsor via the second controlled clutch.

5. The vessel according to claim 3, wherein, when the platform is in the upper position, the second engine coupled to the second propeller propulsor via the third controlled clutch, and the first engine is stopped and the first controlled clutch disengaged so that propellers of the first propeller propulsor rotate freely.

6. The vessel according to claim 3, wherein, when the platform is in the upper position, the second engine is stopped and the third controlled clutch disengaged so that propellers of the first propeller propulsor rotate freely, and the first engine is coupled to the pump jet propulsor via the second controlled clutch.

7. The vessel according to claim 3, wherein, when the platform is in the lower position, the first engine is coupled to the pump jet propulsor via the second controlled clutch, and the second engine can be coupled to the second propeller propulsor via the third controlled clutch.

8. The vessel according to claim 2, wherein the first, second, third, and fourth controlled clutches are hydraulic.

9. The vessel according to claim 2, wherein the first, second, third, and fourth controlled clutches are controlled on-board the vessel.

10. The vessel according to claim 1, wherein the mechanism of each motorized propulsion device comprises hoist means including hydraulic cylinders hinge-mounted between the platform and the two side hulls, and the control means includes a hydraulic pump connected via a hydraulic circuit to the hydraulic cylinders.

11. The vessel according to claim 10, wherein the mechanism of each motorized propulsion device comprises at least two pairs of hydraulic cylinders located along the platform of the vessel and two hydraulic pumps, and the hydraulic cylinders are controlled by the hydraulic pumps.

12. The vessel according to claim 1, wherein the first and second engines are Diesel engines.

13. A catamaran vessel for embarking and disembarking loads, the vessel comprising: two side hulls; a mobile platform, mobile between the two side hulls; motorized propulsion devices arranged symmetrically with respect to the mobile platform, in the two side hulls, each of the motorized propulsion devices including: aft in the respective side hull, a propeller propulsor having a rudder located underneath the side hull, to move and maneuver the vessel at relatively high speeds, in a forward portion of the respective side hull, a pump-jet propulsor, the pump-jet propulsor having a nozzle located in the side hull proximate a bottom of the side hull, aspirating water vertically, and expelling the water via the nozzle, the nozzle swiveling through 360° relative to the vessel, enabling maneuvering of the vessel at low speeds, a mechanism for varying the position of the mobile platform, relative to the two side hulls, between an upper position, in which the vessel floats solely via the two side hulls on relatively deep water for use of the propeller propulsor, and a lower position in which the vessel floats via the mobile platform and the two side hulls on relatively shallow water for use of the pump-j et propulsor, and first and second engines for driving the propeller propulsor, the jet-pump propulsor, and the mechanism; control means for controlling the mechanism of each motorized propulsion device for varying the position of the mobile platform, relative to the two side hulls, between the upper and lower positions, depending on navigation conditions, wherein each of the first and second engines is selectively coupleable to the propeller propulsor, the pump-jet propulsor, and the control means.

14. The vessel according to claim 13, wherein the first and second engines are Diesel engines.

15. The vessel according to claim 13, wherein the second engine can be coupled to the propeller propulsor and to the control means and including a first controlled clutch, a first reduction gear, and a first drive shaft coupling the second engine to the propeller propulsor, the first reduction gear having a first input/output coupled to the first drive shaft via the first controlled clutch, a second controlled clutch coupling the second engine to the control means, and a third controlled clutch coupling the first engine to a second input/output of the first reduction gear, and the first and third controlled clutches are reciprocally controlled such that when one of the first and third controlled clutches is disengaged, the other of the first and third controlled clutches is engaged.

16. The vessel according to claim 15, wherein, when the platform is in the upper position, the second engine is coupled to the propeller propulsor via the first reduction gear and the first controlled clutch, the first engine can be coupled to the propeller propulsor via the third controlled clutch and the first reduction gear, and each of the first and second engines is uncoupled from the pump-jet propulsor by the second controlled clutch.

17. The vessel according to claim 15, wherein, when the platform is in the upper position, the second engine is coupled to the propeller propulsor via the first reduction gear and the first controlled clutch, the first engine is coupled to the pump jet propulsor by the second controlled clutch, and each of the first and second engines is uncoupled from the propeller propulsor by the third controlled clutch.

18. The vessel according to claim 15, wherein, when the platform is in the upper position, the second engine is stopped and the first controlled clutch coupling the engineer to the propeller propulsor is disengaged, and the first engine is coupled to the pump-jet propulsor by the second controlled clutch and is uncoupled from the propeller propulsor by the third controlled clutch, enabling propellers of the propeller propulsor to rotate freely.

19. The vessel according to claim 15, wherein the first, second, and third controlled clutches are hydraulic.

20. The vessel according to claim 15, wherein the first, second, and third controlled clutches are controlled on-board the vessel.

* * * * *